US006514109B1

(12) United States Patent
Carlow

(10) Patent No.: US 6,514,109 B1
(45) Date of Patent: Feb. 4, 2003

(54) KAYAK PADDLE ARRANGEMENT

(76) Inventor: Arthur J. Carlow, 101 Corning St., Beverly, MA (US) 01915

( * ) Notice: Subject to any disclaimer, the term of this patent is extended or adjusted under 35 U.S.C. 154(b) by 0 days.

(21) Appl. No.: 09/993,798

(22) Filed: Nov. 24, 2001

(51) Int. Cl.[7] ..... B63H 16/04
(52) U.S. Cl. ..... 440/101
(58) Field of Search ..... 416/74; 440/101, 440/102, 104

(56) References Cited

U.S. PATENT DOCUMENTS

| | | | | | |
|---|---|---|---|---|---|
| 2,554,708 | A | * | 5/1951 | Kosten | 403/229 |
| 4,605,378 | A | * | 8/1986 | Hamilton | 16/429 |
| 5,114,371 | A | * | 5/1992 | Alonzo | 440/101 |
| D343,608 | S | * | 1/1994 | Nazara | D12/215 |
| 5,364,296 | A | * | 11/1994 | Cerny | 416/74 |
| 5,820,424 | A | * | 10/1998 | Steinhour et al. | 440/101 |
| 6,042,438 | A | * | 3/2000 | Dean | 416/74 |
| 6,238,617 | B1 | * | 5/2001 | Strasser et al. | 264/624 |

FOREIGN PATENT DOCUMENTS

| | | | | |
|---|---|---|---|---|
| EP | 0 411 832 A1 | * | 2/1991 | |
| GB | 2 234 932 A | * | 2/1991 | 440/101 |

* cited by examiner

*Primary Examiner*—Stephen Avila
(74) *Attorney, Agent, or Firm*—Don Halgren

(57) ABSTRACT

A paddle arrangement for use in a canoe or kayak, having an elongated curvilinear central handle portion having a first end and a second end. An elongated blade is arranged on the first and on the second end of the curvilinear central handle to define the paddle of a "gull wing" configuration for efficient entry of the blades into water during a paddling exercise.

15 Claims, 3 Drawing Sheets

KAYAK PADDLE ARRANGEMENT

BACKGROUND OF THE INVENTION

1. Field of the Invention

This invention relates to paddles and more particularly to a double paddle arrangement for a kayak.

2. Prior Art

In recent years kayaking has become an increasingly popular sport. It has evolved from an earlier sport of canoeing. Most types of boating are still very similar. Canoers typically use a single straight paddle with a T-shaped grip on its uppermost end. Kayakers, however, tend to sit lower in the water and require greater control.

A number of attempts have been made to improve the paddles of both canoes and kayaks. One such improvement is shown in the U.S. Design Pat. No. 343,608 showing an elongated paddle handle with several bends therealong. These bends apparently provide improved handling of that paddle.

A further paddle is shown in U.S. Pat. No. 6,042,438 to Dean. This paddle also utilizes several bends in its elongated handle for improved control of the paddle.

There is, however, a need for a dual paddle arrangement for a kayak to permit paddling in an easier and safer manner.

It is an object of the present invention to provide a dual paddle arrangement which overcomes the disadvantages of the prior art.

It is a further object of the present invention to provide a paddle arrangement which would permit a more natural feel and comfortable grip to the occupant of the kayak.

It is yet a further object of the present invention to provide a paddle which is balanced and which will store more easily on the top surface of a canoe or a kayak.

It is yet a still further object of the present invention to provide a kayak handle curverture which is safer and less likely to strike the boat therewith.

It is still yet a further object of the present invention to provide a paddle blade which allows more blade surface into the water to provide more efficient use of the power required to move the boat.

BRIEF SUMMARY OF THE INVENTION

The present invention comprises a dual bladed paddle for use by kayakers or canoers. The dual bladed paddle arrangement comprises an elongated curvilinear central handle portion having an elongated, slightly curved paddle blade at each end thereof.

The handle and blade components of the paddle arrangement of the present invention will be described in relation to an imaginary base line. The baseline in this description extends across a knee bend portion at each end of the paddle. The blade portion at each end of the paddle is fitted on to a connector which mates into a male portion adjacent that knee portion of each end of the paddle.

The connector defines an axis extending outwardly through the blade, which is arranged at an angle of about 15 degrees with respect to the imaginary baseline. The central portion of the paddle handle defines an arcuate segment spaced radially adjacent in the midpoint of the baseline. The arcuate portion is of the handle is defined by a radius of about 2.5 feet.

A rower utilizing the dual bladed paddle arrangement of the present invention would place his or her hands immediately inwardly and adjacent of the respective knee bends at each end of the paddle arrangement.

The central portion of the curved handle is further curved in a plane normal to the curve in which the knee bends lie. Thus the handle component of the paddle arrangement has a multiple bend component thereacross, the ends of the paddle handle each having a "gull wing" shape thereto in a first plane, and the central portion of the paddle handle having its curvaliniar boat portion also in a further plane thus defining a multiple curved component to the paddle arrangement.

Each paddle blade has a front face and a trailing face. The front face is rotated about 10 degrees from vertical about the longitudinal axis of the connector portion adjoining each blade and the handle portion thereof.

The multiple curved handle of the dual paddle blade arrangement of the present invention provides a more natural feel and a more comfortable grip for a kayak operator. The "gull wing" configuration permits the elongated blades to enter the water in a more horizontal orientation by virtue of the knee bend configuration with its handle. Such a configuration provides greater power because of the greater surface area of each blade entering the water with less effort by the rower.

The arcuate contour of the central portion of the curvilinear handle will rest more safely on the upper surface of the kayak or canoe to which it may be placed without sliding off or going overboard.

Each blade may be readily removed by virtue of the tubular connector connecting each blade with the curvilinear handle. The blade component which joins the blade with the connector may have a splined configuration thereon so as to permit adjustment of that paddle blade with respect to the curvilinear handle. Other locking means or adjustment means may also be available within the confines of this invention.

The invention thus comprises a paddle arrangement for use in a canoe or kayak, comprising: an elongated curvilinear central handle portion having a first end and a second end; an elongated blade on the first and the second end of the central handle. The first and second ends of the curvilinear handle define a knee bend therein. The knee bends are arranged at an angle of about 10 to 30 degrees with respect to a tangent base line arranged therebetween. The central handle portion is of arcuate configuration at its respective ends knee bends. Each of the blades may be adjustably attached to the knee bends by a connector. Each of the connectors have a longitudinal axis therethrough, and the central handle portion defines a plane, the longitudinal axes of the connector and the plane of the central handle portion are non-coplanar. The plane of the central portion of the handle may be arranged at an angle of about 5 to 20 degrees with respect to the plane of the handle. Each of the blades may have a spline interface with respect to each of their connectors. The central handle portion preferably has a radius of curvature of between 2 feet and 3 feet. The blades are preferably non-symmetric about the axis through their respective connector. Each of the blades has a front face and a trailing face, the front face having a curvilinear surface thereon. The longitudinal axis of each of the connectors is preferably arranged at an angle of between 5 degrees and 20 degrees with respect to the plane of the central handle portion.

The invention also comprises a paddle arrangement for use in a canoe or kayak, comprising: an elongated curvilinear central handle portion having a first end and a second end; an elongated blade on the first and the second end of the central handle to define the paddle of a "gull wing" configuration for efficient entry of the blades into water during a paddling exercise. The blades may be rotationally adjustable at a connector on the handle. The connectors and the handle preferably each have mutually exclusive planes.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
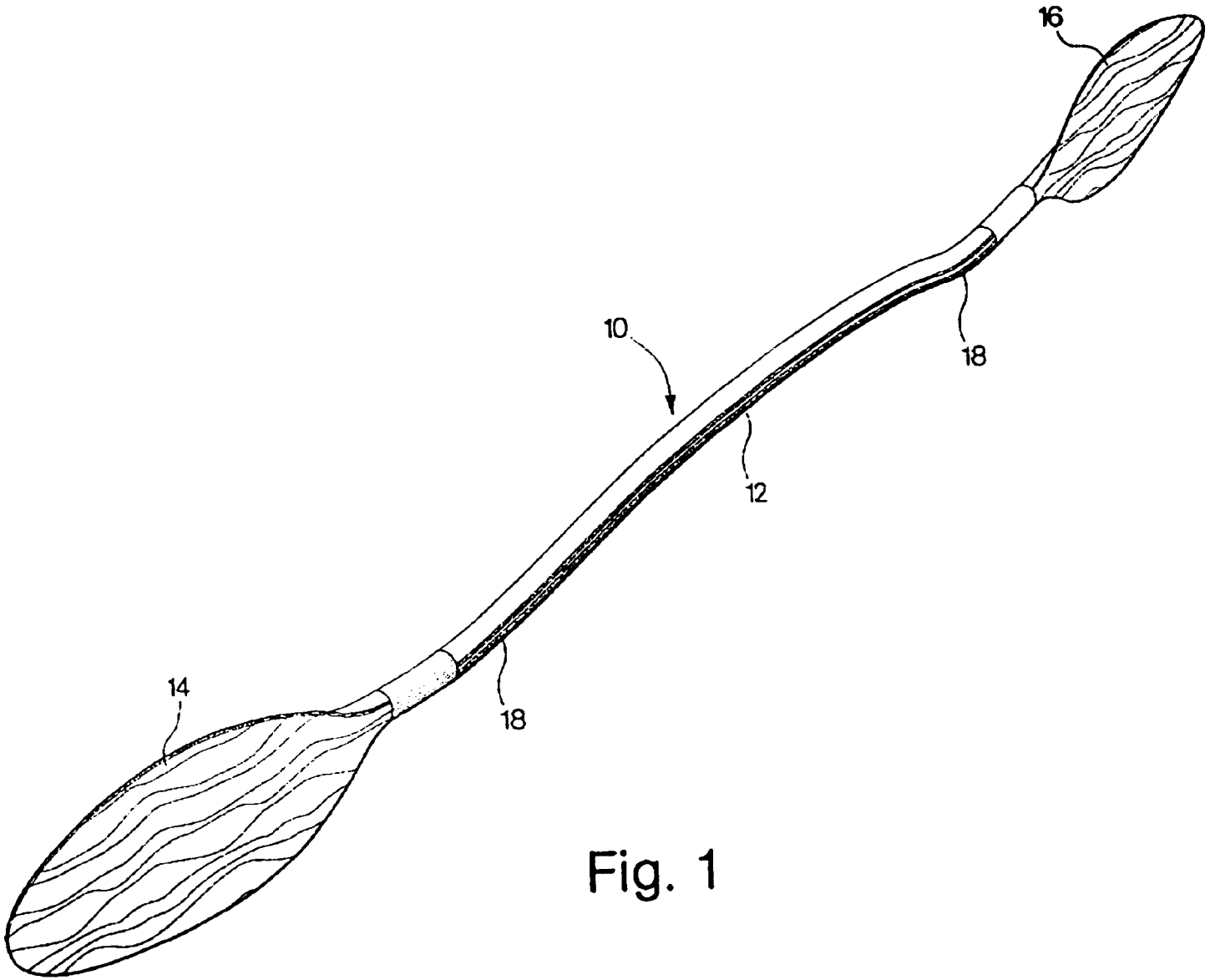
FIG. 1 is a perspective view of a dual bladed paddle arrangement constructed according to the principles of the present invention.
Figure 2:
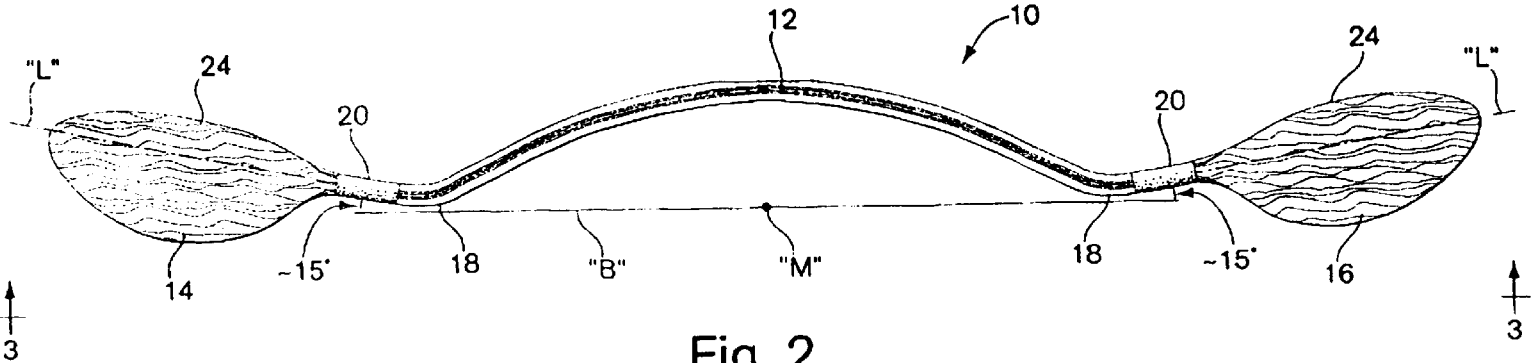
FIG. 2 is a side elevational view of a dual bladed paddle arrangement shown in FIG. 1.
Figure 3:
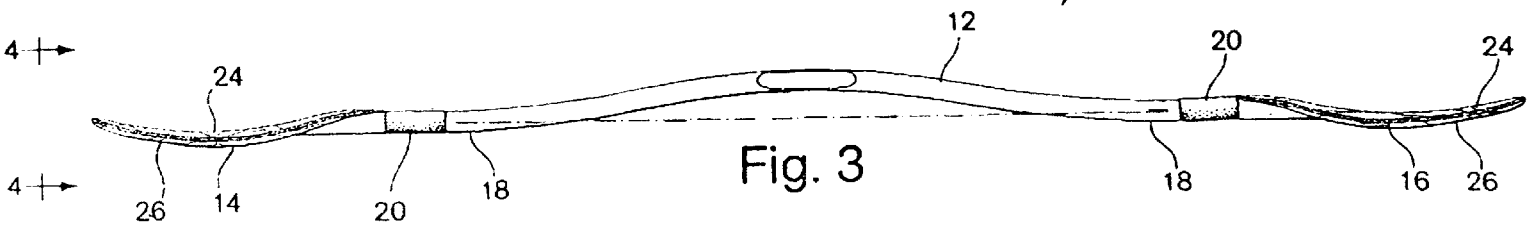
FIG. 3 a view taken along the lines 3—3 of FIG. 2, (as seen looking towards the bottom of the paddle)

Referring now to the drawings in detail, and particularly to FIG. 1, there is shown the present invention comprising a dual bladed paddle arrangement 10 for use by kayakers or canoers. The dual bladed paddle arrangement 10 comprises an elongated curvilinear central handle portion 12 having an elongated, slightly curved paddle blade 14 or 16, one at each end of the central portion 12. The central handle 12 and blade components 14 and 16 of the paddle arrangement 10 will be described in relation to an imaginary base line "B" as indicated by a dashed line in FIG. 2. The baseline "B" in this description extends across a knee bend portion 18 at each end of the paddle 10, as may be seen in FIGS. 1 and 2. The blade portion 14 or 16 at each end of the paddle 10 is fitted on to a sleeve-like connector 20 which mates into a respective male portion (not shown) adjacent that knee portion 18 of each end of the paddle 10. Each connector 20 has a longitudinal axis "L" which extends to the distal most end of each paddle blade 14 and 16, as may be seen in FIG. 2.

The connector 20 thus defines the longitudinal axis "L" extending outwardly through the blade, which axis "L" is arranged at an angle of about 15 degrees with respect to the imaginary baseline "B". The central portion 12 of the paddle handle defines an arcuate segment spaced radially adjacent in the midpoint "M" of the baseline "B". Baseline "B" and axes "L" are arranged at a slight angle with one another as identified hereinbelow. The arcuate central portion of the handle 12 is defined by an arc having a radius of about 2.5 feet.

A rower utilizing the dual bladed paddle arrangement 10 of the present invention would place his or her hands immediately inwardly and adjacent of the respective knee bends 18 at each end of the paddles 14 and 16 for power and control not presented by the art.

Figure 4:
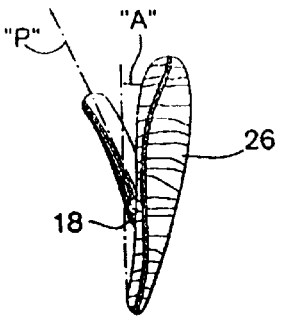
FIG. 4 is a view taken along the lines 4—4 of FIG. 3.
Figure 5:
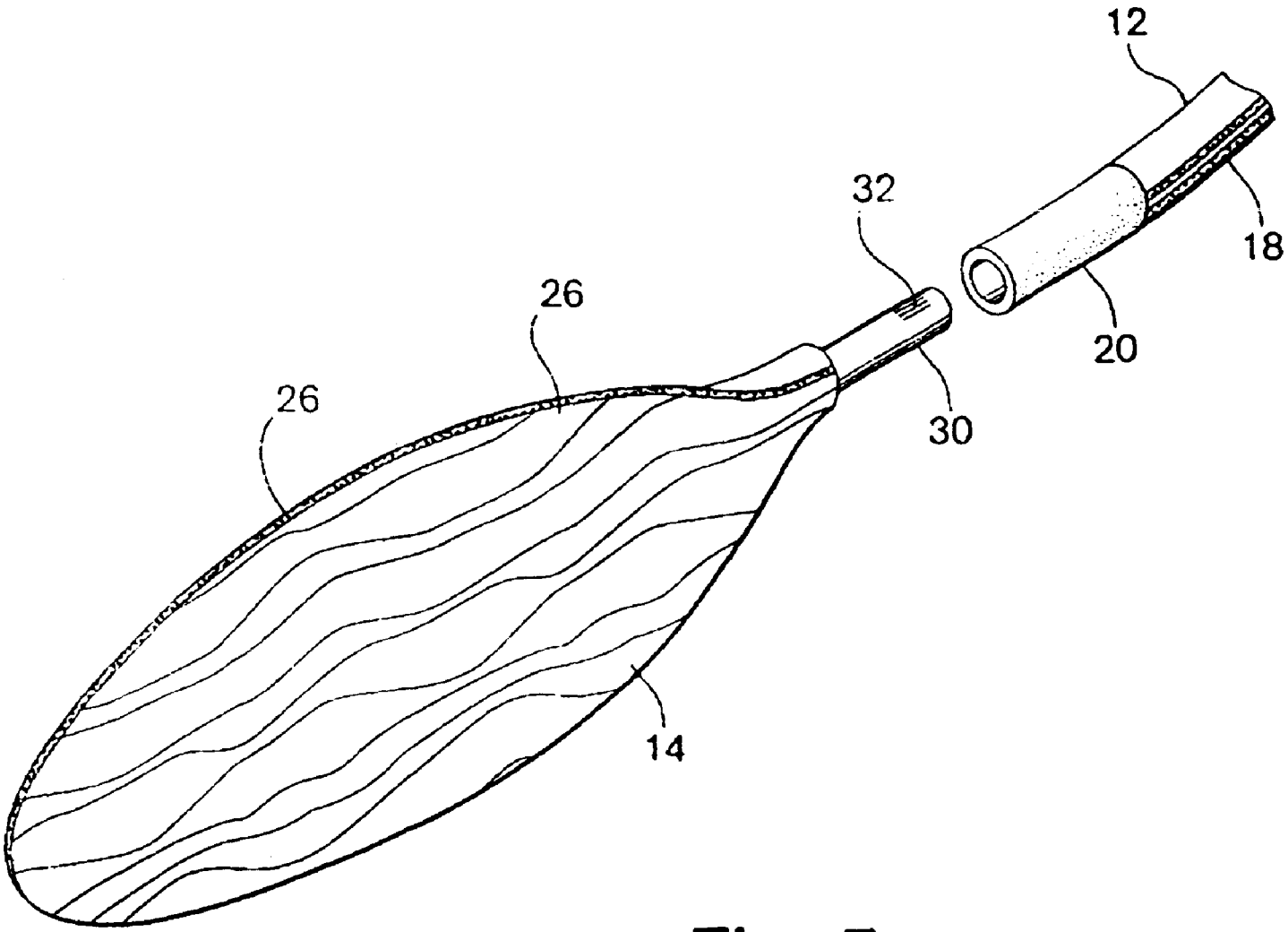
FIG. 5 is an exploded view of a blade and connector arrangement at one end of the curvilinear handle of the present invention.

The central portion of the curved handle 12 is further curved and lies in a plane "P" at an acute angle "A" of about 10 degrees to the curve in which the knee bends 18 lie, as is depicted in an end view of the paddle 10 in FIG. 4. When the paddle 10 is held by a rower the connectors 20 and the blades 14 and 16 are oriented rearwardly by about 5 to 10 degrees to give a better entry into the water and greater force thereby generated by the blades 14 and 16. By these curvatures, the handle component 12 of the paddle arrangement 10 has a multiple bend components thereacross, the ends of the paddle handle 12 each having a "gull wing" shape thereto, as displayed in FIG. 2 in a first plane, and the central portion of the paddle handle having its "water engaging" portions also in a further plane thus defining a multiple curved component to the paddle arrangement 10.

Each paddle blade 14 and 16 has a front face 24 and a trailing face 26. The front face 24 is rotated about 10 degrees from vertical about the longitudinal axis "L" of the connector portion adjoining each blade and the handle portion thereof, as shown in FIG. 4.

The multiple curved handle components of the dual paddle blade arrangement 10 of the present invention provides a more natural feel and a more comfortable grip for a kayak operator. The "gull wing" configuration permits the elongated blades 14 and 16 to enter the water in a more horizontal orientation by virtue of the knee bend configuration 18 with respect the central hand held handle 12. Such a configuration provides greater power because of the greater surface area of each blade 14 and 16 entering the water with less effort by the rower.

The arcuate contour of the central portion of the curvilinear handle 12 permits the paddle 12 to rest more safely on the upper surface of the kayak or canoe to which it may be placed without sliding off or going overboard.

In a further embodiment of the present invention, each blade 14 and 16 may be readily removed from the handle 12 by virtue of the tubular connector 20 connecting each blade 14 and 16 with the curvilinear handle 12. The proximal blade male component 30 which joins its respective blade 14 and 16 with the connector 20 may have a splined configuration 32 thereon, or a set screw arrangement thereon so as to permit rotary adjustment of that paddle blade 14 and/or 16 with respect to the curvilinear handle 12. Other locking means or adjustment means may also be available within the confines of this invention.

I claim:

1. A paddle arrangement for use in a canoe or kayak, said paddle comprising:

an elongated curvilinear central handle portion having a first end and a second end, and each of said first and second ends of said curvilinear handle define a knee bend therein, said first and second knee bends are arranged at an angle of about 10 to 30 degrees with respect to a tangent base line arranged therebetween;

an elongated blade on said first and on said second end of said central handle, wherein said central handle portion is of arcuate configuration and its respective ends have said knee bend thereon.

2. The paddle arrangement as recited in claim 1, wherein each of said first and second ends of said curvilinear handle define a knee bend therein.

3. The paddle arrangement as recited in claim 1, wherein said first and second knee bends are arranged at an angle of about 10 to 30 degrees with respect to a tangent base line arranged therebetween.

4. The paddle arrangement as recited in claim 2, wherein said central handle portion is of arcuate configuration and its respective ends have said knee bend thereon.

5. The paddle arrangement as recited in claim 1, wherein each of said blades is adjustably attached to said knee bend portions of said handle by a connector.

6. The paddle arrangement as recited in claim 1, wherein each of said connectors have a longitudinal axis therethrough, and said central handle portion defines a plane, said longitudinal axes of said connector and said plane of said central handle portion are non-coplanar.

7. The paddle arrangement as recited in claim 6, wherein said plane of said central portion of said handle is arranged at an angle of about 5 to 20 degrees with respect to said plane of said handle.

8. The paddle arrangement as recited in claim 5, wherein each of said blades have a spline interface with respect to each of their said connectors.

9. The paddle arrangement as recited in claim 1, wherein said central handle portion has a radius of curvature of between 2 feet and 3 feet.

10. The paddle arrangement as recited in claim 1, wherein each of said blades are non-symmetric about said axis through their respective said connector.

11. The paddle arrangement as recited in claim 1, wherein each of said blades has a front face and a trailing face, said front face having a curvilinear surface thereon.

12. The paddle arrangement as recited in claim 10, wherein said longitudinal axis of each of said connectors is arranged at an angle of between 5 degrees and 20 degrees with respect to said plane of said baseline touching tangentially said knee bend portions.

13. A paddle arrangement for use in a canoe or kayak, comprising:

an elongated curvilinear central handle portion having a first end and a second end, wherein each said first and second end of said curvilinear handle defines a knee bend therein, said first and second knee bends are arranged at an angle of about 10 to 30 degrees with respect to a tangent base line arranged therebetween, an elongated blade on said first end and said second end of said central handle to define said paddle of a gull wing configuration for efficient entry of said blades into water during a paddling exercise wherein said central handle portion is of arcuate configuration and its respective ends have said knee bend thereon.

14. The paddle arrangement as recited in claim 13, wherein said blades are rotationally adjustable at a connector on said handle.

15. The paddle arrangement as recited in claim 14, wherein said connectors and said central handle portion each have mutually exclusive planes.

* * * * *